US006743029B1

(12) United States Patent
Greene et al.

(10) Patent No.: US 6,743,029 B1
(45) Date of Patent: Jun. 1, 2004

(54) BACK WIRE GROUND CLAMP

(75) Inventors: Jeff Greene, Sea Cliff, NY (US); Anthony Tufano, North Massapequa, NY (US); David B. Balaban, Hauppauge, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/678,318

(22) Filed: Oct. 3, 2003

(51) Int. Cl.[7] ..... H01R 13/648

(52) U.S. Cl. ..... 439/107; 439/801; 175/51; 175/57

(58) Field of Search ..... 439/107, 801; 175/51, 57

(56) References Cited

U.S. PATENT DOCUMENTS 4,900,259 A * 2/1990 Ludwig et al. ..... 439/107
5,266,039 A * 11/1993 Boyer et al. ..... 439/107
5,839,908 A * 11/1998 Bonilla et al. ..... 439/107
5,866,844 A * 2/1999 Osterbrock et al. ..... 174/51
6,188,020 B1 * 2/2001 Osterbrock et al. ..... 174/51
6,293,812 B1 * 9/2001 Ewer et al. ..... 439/107
6,313,403 B1 * 11/2001 Livingston et al. ..... 174/54

* cited by examiner

*Primary Examiner*—Gary Paumen
(74) *Attorney, Agent, or Firm*—Paul J. Sutton

(57) ABSTRACT

The invention here disclosed is a back wire ground clamp for a wiring device such as a switch or receptacle having a ground strap which supports an outwardly projecting ground lug having a front edge and adapted to receive a ground connection. The ground lug is coupled to a clamp plate by means of a screw which passes through a clearance opening in the clamp plate and is threaded into a receiving opening in the ground lug. The clamp plate supports a blocking tab which extends downward below the front edge of the ground lug and extends side ways for a distance which is less than the length of the front edge of the ground lug. The blocking tab prevents the clamp plate from rotating relative to the ground lug as the screw is tightened and defines an opening between the clamp plate and the ground lug along the front edge of the ground lug into which a single ground wire can be inserted.

10 Claims, 4 Drawing Sheets

BACK WIRE GROUND CLAMP

BACKGROUND OF THE INVENTION

1. Field of the Invention

This invention relates generally to electrical wiring devices such as electrical switches, receptacles and the like and more particularly to a clamp for back wiring a ground wire to a ground strap.

2. Description of the Prior Art

Electrical switches and receptacles that are used in homes, offices and factories have terminals to which electrical wires are connected by turning a screw down on the wire. The electrical wire is usually a relatively stiff solid wire that must first be shaped into a loop to fit around the mounting screw and then the mounting screw is screw down. The bending of the wire takes time and, if the loop is placed under the screw where the loop is positioned to be turning in a counter-clockwise direction rather than in a clockwise direction, the loop will tend to open up and move out from under the head of the screw as the screw is tightened in a clockwise direction. Additionally, in many instances it is faster and easer to connect a conductor to the rear of a switch or receptacle rather than to a side contact.

Conventional switches and receptacles are provided with compartments located on the side of the device for receiving the electrical conductors of a wiring cable. More specifically, each switch or receptacle is provided with a separate side located screw or clamping device for achieving electrical connection between the individual conductors or wires and the terminal on the switch or receptacle. Normally two wires are present for providing power to the switch or receptacle and a third wire is provided for a ground connection.

As disclosed in U.S. Pat. Nos. 6,188,020 and 5,866,844 to Osterbrock et al., to improve the way that a wire can be connected to a ground strap of a switch or a receptacle, a clamping plate is provided which overlies a base plate. The configuration of the clamping plate facilitates the connection of the ground wire to the ground strap from the rear. Another arrangement for clamping a ground conductor to a ground strap from the rear is disclosed in U.S. Pat. No. 6,293,812 to Ewer et al.

The clamping plate arrangements disclosed in the prior art are generally complex in shape and relatively expensive to manufacture.

What is needed is a new improved clamping plate and ground strap arrangement for connecting a ground wire to a ground terminal from the rear of the switch or receptacle that is simple in design, economical to make and easy to use.

SUMMARY OF THE INVENTION

The invention here disclosed is a back wire ground clamp for a wiring device such as a switch or receptacle having a ground strap which supports an outwardly projecting ground lug having a front edge and adapted to receive a ground connection. The ground lug is coupled to a clamp plate by means of a screw which passes through a clearance opening in the clamp plate and is threaded into a receiving opening in the ground lug. The clamp plate supports a blocking tab which extends downward below the front edge of the ground lug and extends side ways for a distance which is less than the length of the front edge of the ground lug. The blocking tab prevents the clamp plate from rotating relative to the ground lug as the screw is tightened and defines an opening between the clamp plate and the ground lug along the front edge of the ground lug into which a single ground wire can be inserted.

BRIEF DESCRIPTION OF THE INVENTION

Other aspects, features, and advantages of the present invention will become more fully apparent from the following detailed description, the appended claim, and the accompanying drawings in which similar elements have similar reference numerals.

DETAILED DESCRIPTION OF THE INVENTION

Figure 1:
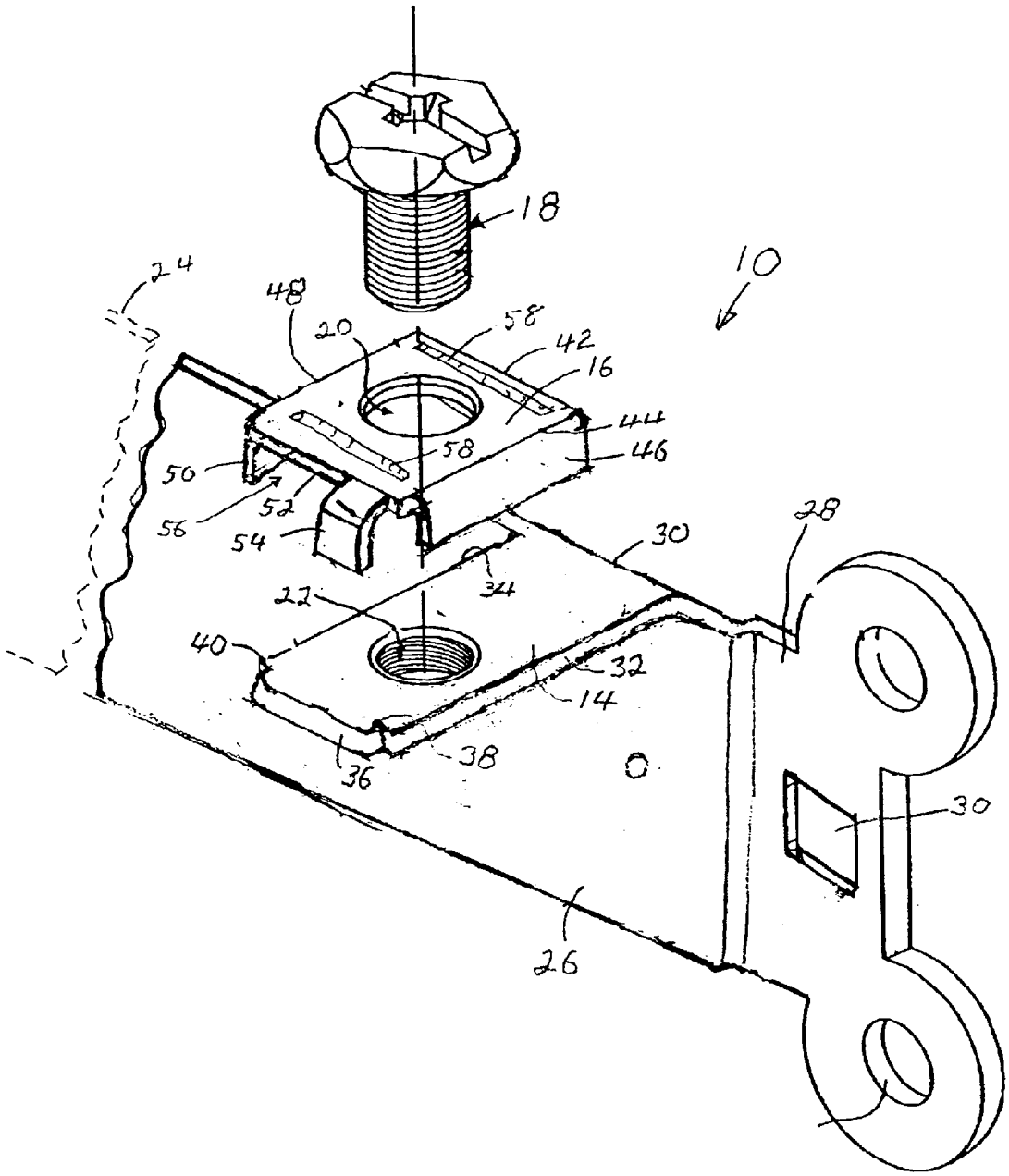
FIG. 1 is an exploded perspective view of a back wire ground clamp in accordance with the principles of the invention.
Figure 2:
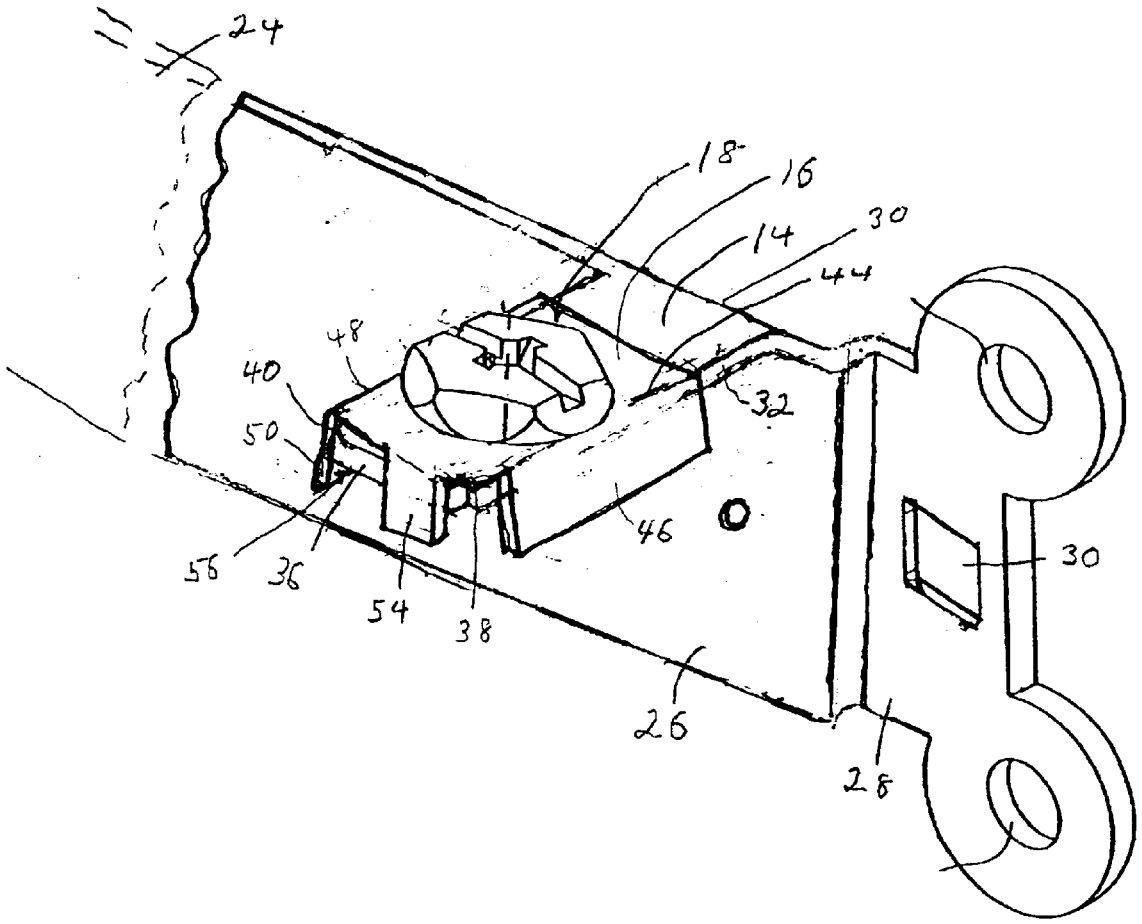
FIG. 2 is a perspective view of the back wire ground clamp of FIG. 1 set to receive a ground wire.
Figure 3:
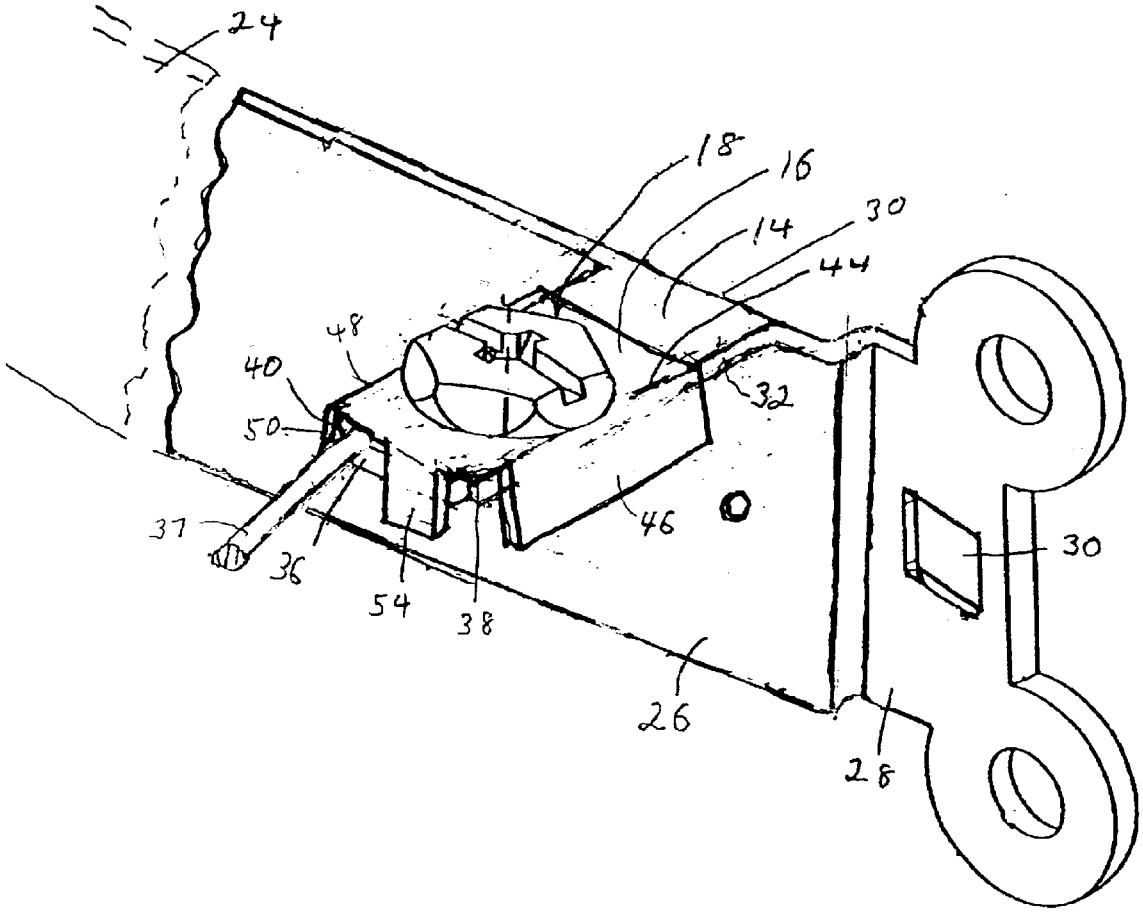
FIG. 3 is a perspective view of the back wire ground clamp of FIG. 1 clamped to a ground wire.
Figure 7:
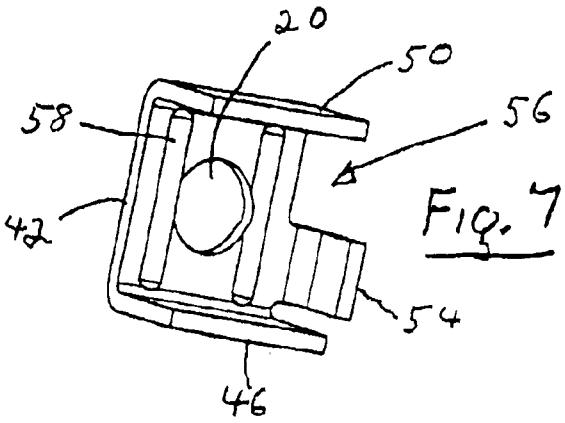
FIG. 7 is an isometric view of the clamp plate.
Figure 6:
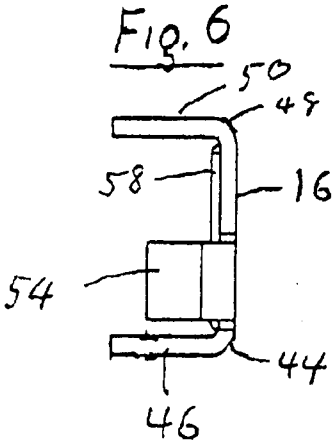
FIG. 6 is a front view of the clamp plate.
Figure 5:
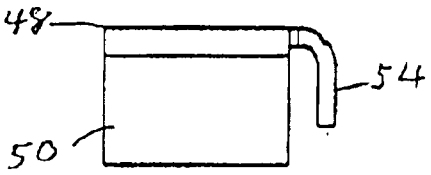
FIG. 5 is a side view of the clamp plate.
Figure 4:
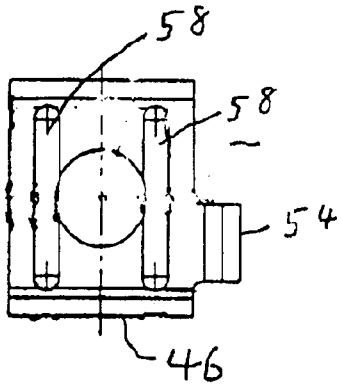
FIG. 4 is a bottom view of the clamp plate.
Figure 1:
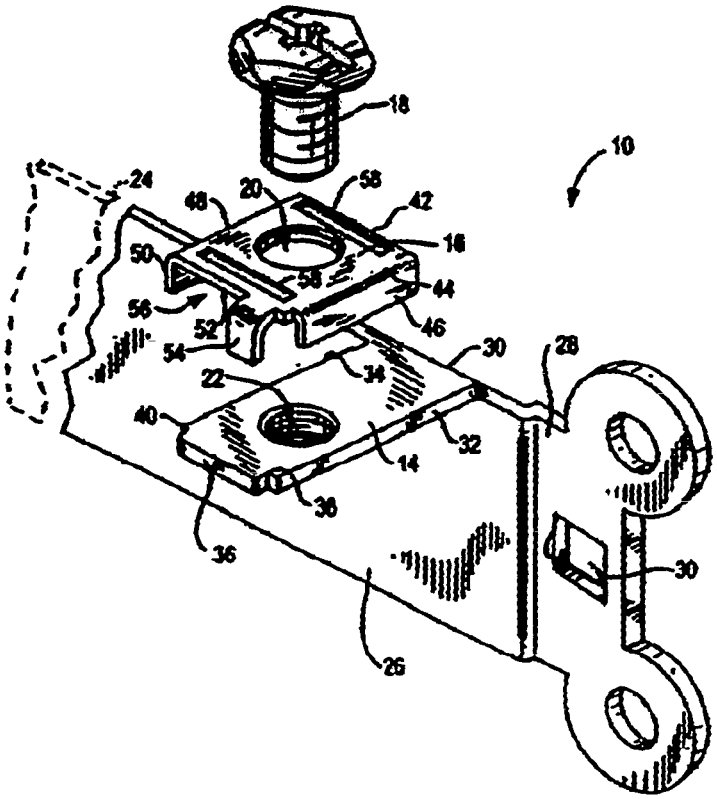
Figure 2:
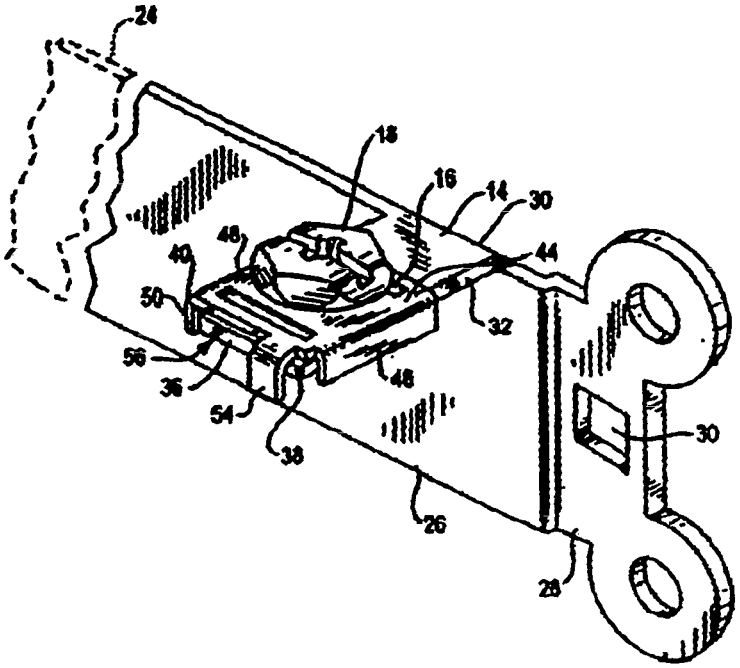
Figure 3:
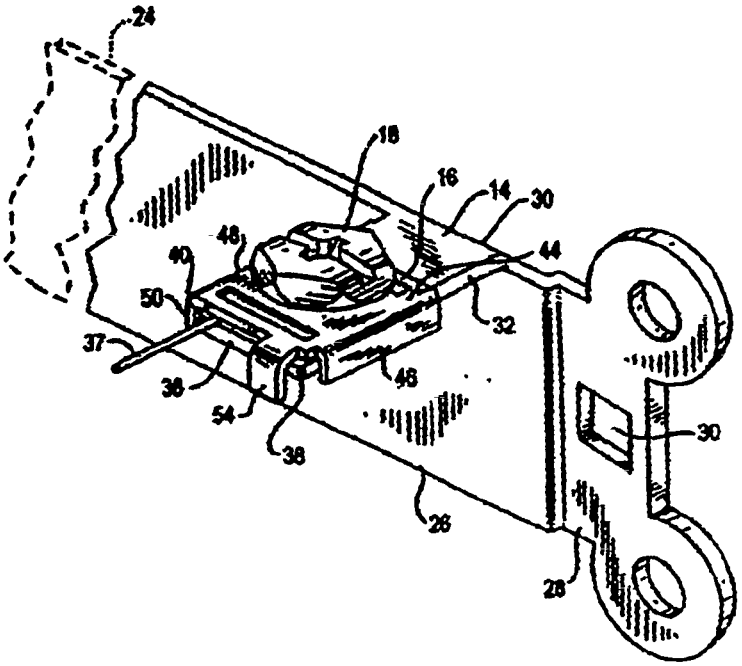
Figure 4:
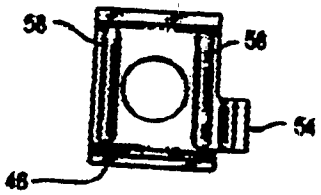
Figure 5:
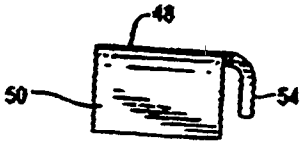
Figure 6:
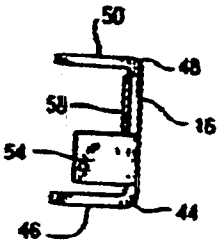
Figure 7:
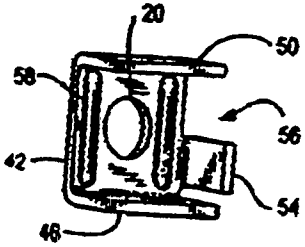

Referring to FIG. 1, a back wire ground clamp 10 according to an embodiment of the invention consists of a ground strap 12 having a ground lug 14 which is adapted to be engage by a clamp plate 16 having a substantially rectangular flat plate that supports three tabs. The tabs extend outward at right angles to the flat plate and are arranged to engage two side edges and a front edge of the ground lug. A screw 18, which extends through a clearance opening 20 in clamp plate 16, is provided to engage a screw threaded opening 22 in ground lug 14.

In the embodiment here shown the ground strap supports the ground lug 14 to provide the ground connection for an electrical switch or an electrical receptacle. An electrical ground connection is made by connecting a ground wire to the ground strap. The invention here disclosed can bb used for any contact member of a receptacle or a switch, but the invention is particularly well adapted for use as a ground clamp on a switch or receptacle that is back wired.

The ground strap 12 is formed from a single piece of conductive metal having a ground lug 14 projecting outwardly there from. The ground strap 12 has a center portion 24 (not shown) located between a first intermediate portion 26 and a second intermediate portion (not shown). A mounting lug 28 is located at the end of each intermediate portion 26. Depending on the method used to mount the ground strap to an electrical device such as a switch or a receptacle, the shape of the center portion of the ground strap relative to the center portion will vary. For example when the ground strap is used with an electrical switch (not shown), the ground strap will generally extend along the top length of the switch and will be substantially flat from one mounting lug to the other. The switch will be securely attached to the center portion of the ground strap with rivets. When the ground strap is used with an electrical receptacle (not shown), the ground strap will generally extends along the bottom length of the receptacle. The center portion 24 of the ground strap will be perpendicular to the first and second intermediate portions; and the mounting lugs 28 will be perpendicular to the intermediate portions and substantially parallel to the center portion 24, and extends from the intermediate portions in a direction which is opposite to that of the center portion.

In each instance, the mounting lugs 28 of the ground strap will extend laterally outward from the switch or the receptacle and will be provided with openings 30 for receiving screws for mounting the switch or receptacle to an outlet box.

Continuing with FIG. 1, the ground lug 14 extends outward from an edge of the first intermediate portion of the ground strap and at a right angle to the ground strap. Thus, the ground lug is substantially perpendicular to the center portion 24 and the first intermediate portion 26 of the ground strap.

The ground lug 14 is generally rectangular is shape having one back edge 30 coupled to the first intermediate portion of the ground strap. Side edges 32, 34 and front edge 36 are generally straight free edges. The two corners of the ground lug where side edge 32 meets front edge 36 and where side edge 34 meets front edge 36 are turned up slightly to form a first corner rise 38 and a second corner rise 40, the ends of which are slightly above the top surface of the ground lug. Screw thread opening 22, which is sized to accept a standard terminal screw, extends perpendicularly through and is centrally located in the ground lug 14. Thus, ground lug 14 is very economical to form as it is a relatively flat strip of conductive metal having only a single threaded opening and two corner rises 38, 40.

Continuing with FIG. 1, clamp plate 16 is substantially rectangular in shape having a straight uninterrupted back edge 42, a first side edge 44 having a retaining tab 46, a second side edge 48 having a retaining tab 50, and a front edge 52 having a blocking tab 54. Blocking tab 54 perform two functions, the first is to provide an opening between the front end of the edge of tab 50 and the left edge of the tab 54 for a ground wire to pass through and the second is to prevent more than one ground wire from being be inserted into the opening. Clearance opening 20 in clamp plate 16 is sized to allow screw 18 to freely pass through and is in alignment with opening 22 when the three tabs 46, 50 and 54 are positioned to engage the edges 32, 34 and 36 of the ground lug 14. Clamp plate 16 is normally composed of the same conductive metal that is used to make the ground strap.

Referring to FIGS. 4 through 7, the blocking tab extends from the first side edge 44 along the front edge 52 to a point that is substantially in alignment with the center line of clearance opening 20. Thus, blocking tab 54 prevents a ground wire from being placed on the right side of screw 18. The blocking tab extends downward a distance sufficient to block or cover the edge 36 of the ground lug 14.

With the screw 18 located in clearance opening 20 and threaded loosely in threaded opening 22 such that clamp plate 16 is loosely positioned above ground lug 14 a distance sufficient to allow a ground wire to be placed between the clamp plate and the ground terminal plate, the blocking tab 54 is sized to extend downward a distance that is at least equal to and preferably below the edge of the ground lug 14 to inhibit or block a ground wire from being inserted between the edge 36 of the ground lug and the lower edge of the blocking tab 54. Retaining tabs 48, 46 are sized to extend beyond the side edges 32, 34 of ground lug which prevents the clamp plate from rotating relative to the ground lug. With this arrangement, only a single ground wire can be inserted between the ground lug 14 and the clamp plate 16 through the opening 56 and the ground wire can only be inserted to be on the left side of the screw 18. Corner rise 40 and retaining tab 50 function as a guide members to urge an inserted ground wire to move away from the edge 34 of the ground lug.

Downward extending rails 58 embossed in the top surface of the clamp plate 16 extend from edge 48 to edge 44. The rails protrude into the lower surface of the clamp plate and are positioned to engage and bite into the ground wire located between the ground lug 14 and the clamp plate 16 to hold it in a secure manner.

Referring to FIGS. 4, 5, 6, and 7, there is shown a bottom, side, front and isometric view of the clamp plate 16.

A back wire ground clamp in accordance with the principles of the invention as shown and described herein is simple in design, economical to manufacture and easy to use.

As shown in FIG. 1, the ground strap can be formed by punching out a blank ground strap from sheet or strip material where the blank includes the ground lug 14 having corner rises 38, 40 and an opening 22 sized to be threaded to receive screw 18. Thereafter, opening 22 can be threaded and the blank can be shaped the specific configuration desired. Also from electrical conducting sheet or strip material, a blank of the clamp plate 16, including clearance opening 20 and rails 58 can be blanked out and bent to form the clamp plate substantially as shown in the Figs.

The back wire ground clamp is assembled by placing the clamp plate over the ground lug with the blocking tab 54 being in front of the front edge of the ground lug and the retaining tabs 46, 48 being adjacent to the edges 32, 34 of the ground lug. Screw 18 is then inserted through the clearance opening 20 and partially threaded into the threaded opening 22. At this time the ground lug and clamp plate are free to move toward and away from each other a distance which is sufficient to allow a ground wire to be inserted between them, but they are not free to rotate relative to each other. The screw prevents the ground lug from separating from the clamp plate and the retaining tabs 46 and 48 prevent the clamp plate from rotating relative to the ground lug. After a ground wire 37 is inserted between the ground lug and the clamp plate, screw 18, having a threaded shaft and a head, is tightened to clamp the ground wire in position between the ground lug and clamp plate. As the screw is tightened, the embossed rails bite into the ground wire to provide a good electrical connection between the ground wire and the ground lug. The opening 56 formed by blocking tab 54 and the end of the retaining tab 50 is oriented to readily accept a ground wire from the back and allows only a single ground wire to be connected to the back wire ground clamp.

While there have been shown and described and pointed out the fundamental novel features of the invention as applied to the preferred embodiments, it will be understood that various omissions and substitutions and changes of the form and details of the device illustrated and in its operation may be made by those skilled in the art without departing from the spirit of the invention.

What is claimed is:

1. A wiring device comprising:

a ground strap;

a ground lug to which a ground connection is to be made having a back edge, a first side edge, a second side edge, and a front edge coupled to the ground strap along the back edge;

a threaded opening in the ground lug;

a clamp plate having a clearance opening, a front edge, a first side edge, a second side edge and a back edge;

a blocking tab extending downwardly at a right angle from the front edge of the clamp plate;

a screw having a threaded body and a head wherein the threaded body extends through the clearance opening in the clamp plate and engages the threaded opening in the ground lug to position the clamp plate between the ground plate and the head of the screw;

wherein the blocking tab extends in front of the front edge of the ground lug prevent rotation of the clamp plate relative to the ground lug.

2. The wiring device of claim 1 wherein:

the first side edge, the second side edge and the front edge of the ground lug are substantially straight.

3. The wiring device of claim 2 wherein:

the corner of the ground lug where the first side edge and the front edge meet is bent toward the clamp plate to form a corner rise.

4. The wiring device of claim 3 wherein:

the corner of the ground lug where the second side edge and the front edge meet is bent toward the clamp plate to form a corner rise.

5. The wiring device of claim 3 wherein:

the blocking tab on the clamp plate extends along the front edge of the ground lug from a side edge to a point approximate the center of the front edge to block a ground wire form being inserted between the ground lug and the clamp plate.

6. The wiring device of claim 5 wherein:

the first side edge of the clamp plate is coupled to a first retaining tab that extends downwardly below the first side edge of the ground lug.

7. The wiring device of claim 6 wherein:

the second side edge of the clamp plate is coupled to a second retaining tab that extends downwardly below the second side edge of the ground lug.

8. The wiring device of claim 7 wherein:

the ground strap is for an electrical switch.

9. The wiring device of claim 7 wherein:

the ground strap is for a receptacle.

10. The wiring device of claim 1:

wherein the ground strap, the ground lug and the clamp plate are of a conducting material.

* * * * *

UNITED STATES PATENT AND TRADEMARK OFFICE

CERTIFICATE OF CORRECTION

PATENT NO. : 6,743,029 B1 
APPLICATION NO. : 10/678318
DATED : June 1, 2004
INVENTOR(S) : Jeff Greene, Anthony Tufano and David B. Balaban It is certified that error appears in the above-identified patent and that said Letters Patent is hereby corrected as shown below:

On the title page, change the print figure at bottom as shown in the attached sheet.

Replacement of informal drawings ( Figures 1-7) with formal drawings of figures 1-7 see attached.

In column 6 line 2, change “form” to -- from --.

Signed and Sealed this

Fourteenth Day of August, 2007

JON W. DUDAS
*Director of the United States Patent and Trademark Office*

(12) United States Patent
Greene et al.

(10) Patent No.: US 6,743,029 B1
(45) Date of Patent: Jun. 1, 2004

(54) BACK WIRE GROUND CLAMP

(75) Inventors: Jeff Greene, Sea Cliff, NY (US); Anthony Tufano, North Massapequa, NY (US); David B. Balaban, Hauppauge, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/678,318

(22) Filed: Oct. 3, 2003

(51) Int. Cl.[7] ..... H01R 13/648

(52) U.S. Cl. ..... 439/107; 439/801; 175/51; 175/57

(58) Field of Search ..... 439/107, 801; 175/51, 57

(56) References Cited

U.S. PATENT DOCUMENTS 4,900,259 A * 2/1990 Ludwig et al. ..... 439/107
5,266,039 A * 11/1993 Boyer et al. ..... 439/107
5,859,908 A * 11/1998 Bonilla et al. ..... 439/107
5,866,844 A * 2/1999 Osterbrock et al. ..... 194/51
6,188,020 B1 * 2/2001 Osterbrock et al. ..... 174/51
6,293,812 B1 * 9/2001 Bwer et al. ..... 439/107
6,313,403 B1 * 11/2001 Livingston et al. ..... 174/54

* cited by examiner

*Primary Examiner*—Gary Paumen
(74) *Attorney, Agent, or Firm*—Paul J. Sutton

(57) ABSTRACT

The invention here disclosed is a back wire ground clamp for a wiring device such as a switch or receptacle having a ground strap which supports an outwardly projecting ground lug having a front edge and adapted to receive a ground connection. The ground lug is coupled to a clamp plate by means of a screw which passes through a clearance opening in the clamp plate and is threaded into a receiving opening in the ground lug. The clamp plate supports a blocking tab which extends downward below the front edge of the ground lug and extends side ways for a distance which is less than the length of the front edge of the ground lug. The blocking tab prevents the clamp plate from rotating relative to the ground lug as the screw is tightened and defines an opening between the clamp plate and the ground lug along the front edge of the ground lug into which a single ground wire can be inserted.

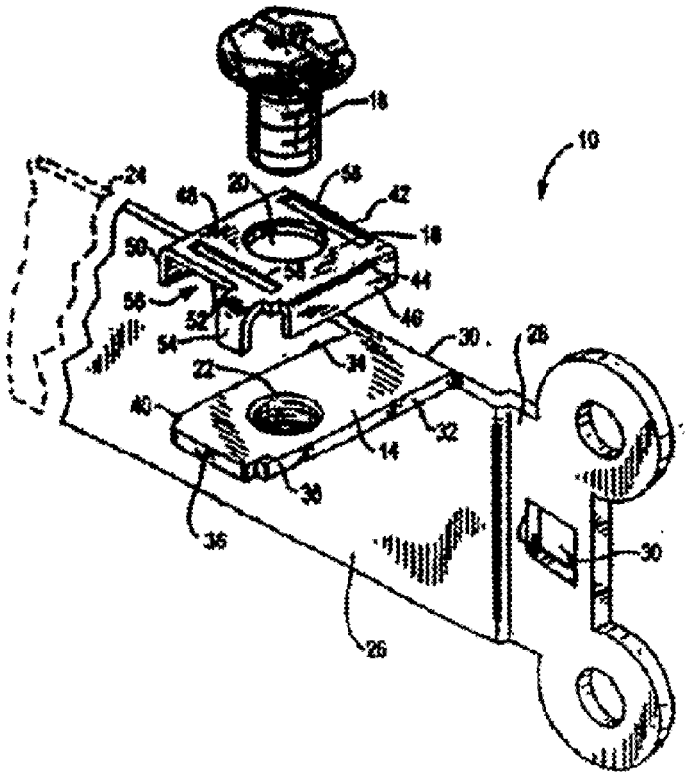

10 Claims, 4 Drawing Sheets